United States Patent [19]

Murai et al.

[11] Patent Number: 4,770,007

[45] Date of Patent: Sep. 13, 1988

[54] VERTICALLY COMPACT CRYOSTAT

[75] Inventors: Takashi Murai; Katsuyoshi Toyoda, both of Kobe; Akinori Ohara, Amagasaki, all of Japan

[73] Assignee: Mitsubishi Denki Kabushiki Kaisha, Tokyo, Japan

[21] Appl. No.: 114,982

[22] Filed: Oct. 30, 1987

[30] Foreign Application Priority Data

Dec. 4, 1986 [JP] Japan ..... 61-188412[U]

[51] Int. Cl.[4] ..... F25B 19/00

[52] U.S. Cl. ..... 62/514 R

[58] Field of Search ..... 62/55.5, 514 R

[56] References Cited

U.S. PATENT DOCUMENTS 3,009,629 11/1961 Garin et al. ..... 62/55.5

3,168,819 2/1965 Santeler ..... 62/55.5

4,072,025 2/1978 Thibault ..... 62/55.5

*Primary Examiner*—Ronald C. Capossela

*Attorney, Agent, or Firm*—Sughrue, Mion, Zinn, Macpeak and Seas

[57] ABSTRACT

A vertically compact cryostat includes a housing 2 having a cylindrical lower chamber 3*a* containing a superconducting coil 1 and a contiguous, larger diameter, overhanging upper chamber 3*b* serving as a liquid helium reservoir. An annular liquid nitrogen tank 15 surrounds the lower chamber and underlies the upper chamber overhang to thermally insulate the helium and minimize the evaporation thereof. The assembly is completed by a metallic thermal shield 17 attached to the tank and enclosing the housing, and a vacuum vessel surrounding the tank and shield.

1 Claim, 1 Drawing Sheet

VERTICALLY COMPACT CRYOSTAT

BACKGROUND OF THE INVENTION

1. Field of the Invention

This invention relates to a cryostat which houses a superconducting coil, and more particularly to a compact cryostat whose external height is reduced.

2. Description of the Prior Art

FIG. 1 shows a schematic sectional view of a conventional cryostat as disclosed on page 425 of the Proceedings of the 9th International Conference on Magnet Technology, Zurich, Switzerland (1985), wherein a superconducting electromagnet coil 1, for example, is disposed in a bath of liquid helium 4 in the lower chamber 3*a* of a housing 2. The housing includes a larger diameter upper chamber 3*b* serving as a reservoir for an additional volume of liquid helium. A tank 5 containing liquid nitrogen 6 is disposed above the housing 2, which is surrounded by a thermal shield 7 made of copper, aluminum or the like. The shield 7 and the nitrogen tank 5 are in turn surrounded by a vacuum vessel 8, and the spaces 9 flanking the shield are evacuated to thermally insulate the assembly.

In the operation of any cryostat it is necessary to periodically replenish the liquid helium supply. To reduce the frequency of such replenishment and thus prolong the operating period of the superconducting coil, the larger diameter upper chamber reservoir 3*b* is provided.

The liquid helium 4, which is at a very low temperature and has a small latent heat, will easily evaporate upon a slight external heat loss due to thermal conduction. To minimize such evaporation the conventional cryostat is thus provided with the liquid nitrogen tank 6 to thermally insulate the liquid helium together with the attached thermal shield 7.

Such a conventional cryostat construction is undesirably high due to the disposition of the nitrogen tank above the helium reservoir, and is difficult to economically fabricate owing to the stepped configuration of the thermal shield and the vacuum vessel.

SUMMARY OF THE INVENTION

These disadvantages are overcome in accordance with the invention by providing a vertically compact cryostat wherein the nitrogen tank has an annular configuration and is disposed surrounding the lower chamber and underlying the overhang of the larger diameter upper helium reservoir chamber.

DETAILED DESCRIPTION OF THE PREFERRED EMBODIMENT

Figure 1:
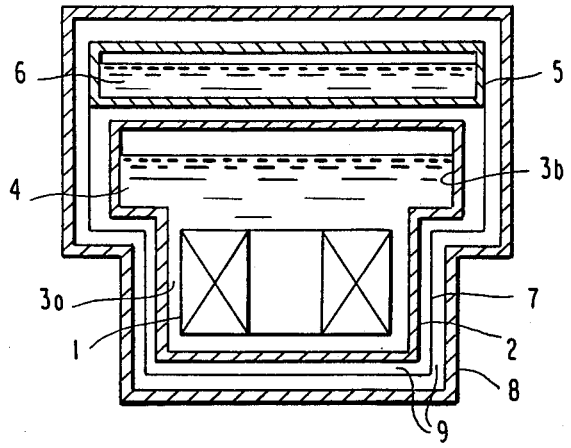
FIG. 1 PRIOR ART
FIG. 1 is a sectional view showing a conventional cryostat.
Figure 2:
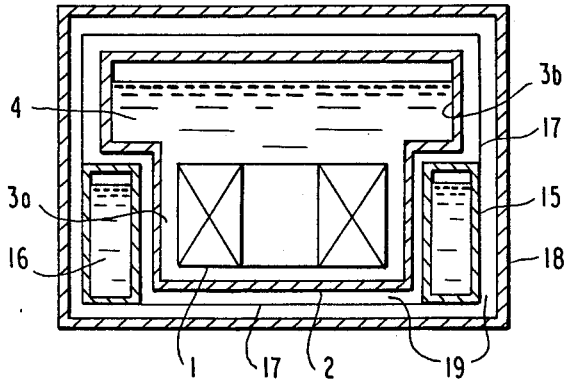
FIG. 2 is a sectional view showing an embodiment of the cryostat in accordance with the present invention.

Referring to FIG. 2, the elements designated by reference numerals 1 through 4 are substantially identical to those previously described in connection with FIG. 1.

In accordance with the invention, an annular tank 15 containing liquid nitrogen 16 is disposed around the lower chamber 3*a* containing the superconducting coil, and beneath the stepped outer portion of the larger diameter upper reservoir chamber 3*b* of the housing 2. A thermal shield 17 of copper, aluminum or the like is attached to the nitrogen tank 15 and encloses the upper housing chamber 3*b*. The tank 15 and shield 17 are in turn surrounded by a vacuum vessel 18, and the spaces 19 on opposite sides of the shield are evacuated as before.

With such a construction the otherwise vacant annular recess or instep surrounding the smaller diameter coil chamber 3*a* is thus used to accommodate the nitrogen tank 15, which serves to reduce the overall height of the cryostat. In addition, the resulting rectangular section of the vacuum vessel 18 and the thermal shield 17 facilitates their manufacture and reduces the cost thereof. Furthermore, when it is desired to increase the operating period of the superconducting coil 1, the required enlargement of the helium reservoir chamber 3*b* and the liquid nitrogen tank 15 can be minimized in comparison with the conventional cryostat without any overall increase in height.

What is claimed is:

1. A vertically compact cryostat, comprising:

(a) a housing (2) defining a cylindrical lower chamber (3*a*) and a contiguous, larger diameter, cylindrical upper chamber (3*b*), (b) a superconducting coil (1) disposed in the lower chamber, (c) a bath of liquid helium (4) in the housing filling the lower chamber to surround the coil and extending into the upper chamber to provide a reservoir of liquid helium, (d) an annular tank (15) surrounding the lower chamber and underlying an outwardly extending portion of the upper chamber, (e) a volume of liquid nitrogen (16) disposed in the tank to thermally insulate the liquid helium and minimize the evaporation thereof, (f) a thermal shield (17) attached to the tank and enclosing the housing, and (g) a vacuum vessel (18) surrounding the tank and the shield, with spaces (19) on opposite sides of the shield being evacuated, wherein:

(h) said vacuum vessel is rectangular in sectional view, (i) the nitrogen tank is spaced from the upper and lower chambers of the housing, (j) an outer periphery of the nitrogen tank extends radially outwardly beyond an outer periphery of the upper chamber, (k) a bottom surface of the nitrogen tank extends downwardly beyond a bottom surface of the lower chamber, (l) a first portion of the thermal shield extends across the bottom surface of the nitrogen tank and below the bottom surface of the lower chamber, and (m) a second portion of the thermal shield extends upwardly from the outer periphery of the nitrogen tank to surround the outer periphery of the upper chamber, and across and above an upper surface of the upper chamber, whereby continuous inner and outer spaces separated by the tank and attached shield are defined surrounding the housing and within the vessel, respectively.

* * * * *